US006536363B1

(12) United States Patent
Carlberg

(10) Patent No.: US 6,536,363 B1
(45) Date of Patent: Mar. 25, 2003

(54) DEVICE FOR RAMPS

(75) Inventor: Gustaf Carlberg, Kungsbacka (SE)

(73) Assignee: MacGregor Sweden AB (SE)

( * ) Notice: Subject to any disclaimer, the term of this patent is extended or adjusted under 35 U.S.C. 154(b) by 0 days.

(21) Appl. No.: 09/913,551

(22) PCT Filed: Jul. 13, 2000

(86) PCT No.: PCT/SE00/01481

§ 371 (c)(1),
(2), (4) Date: Aug. 15, 2001

(87) PCT Pub. No.: WO01/03998

PCT Pub. Date: Jan. 18, 2001

(30) Foreign Application Priority Data

Jul. 14, 1999 (SE) ..... 9902714

(51) Int. Cl.[7] ..... B63B 25/00; B63B 27/14

(52) U.S. Cl. ..... 114/72; 14/71.1; 414/137.9

(58) Field of Search ..... 114/72; 14/69.5, 14/71.1, 71.3, 71.7; 414/137.1, 137.9, 138.2, 138.5, 138.7

(56) References Cited

U.S. PATENT DOCUMENTS 2,759,207 A * 8/1956 Pennington
3,846,860 A * 11/1974 Kummerman ..... 14/71
3,879,784 A * 4/1975 Kummerman ..... 14/71
4,043,288 A 8/1977 Vulovic
4,162,551 A * 7/1979 Serrano ..... 14/71.1
4,333,196 A * 6/1982 Bougaran ..... 14/71.1
4,369,538 A * 1/1983 Smedal ..... 14/69.5
4,590,634 A 5/1986 Williams
6,192,541 B1 * 2/2001 Castelli et al. ..... 14/69.5

FOREIGN PATENT DOCUMENTS

DE 37 20 552 A1 1/1989
EP 0 245 227 A2 11/1987

* cited by examiner

*Primary Examiner*—Sherman Basinger
(74) *Attorney, Agent, or Firm*—Lerner, David, Littenberg, Krumholz & Mentlik, LLP

(57) ABSTRACT

Device for ships having at least one ship's ramp (2) which at an inner end (3) is pivotally connected with the ship and in a loading position at an outer end (5) is supported by an offboard surface (18) for cargo to be transported between a deck (7) of the ship and said offboard surface by means of the ship's ramp. The ship's ramp varies in angular relationship relative to the offboard surface due to movements in the water surface of the sea. The device (1) includes a platform (21), which is pivotally suspended in a base unit (27) by means of pivot means (28). The platform (21) has top support means (22) provided to receive and support the outer end (5) of the ship's ramp (2). The base unit (27) has bottom support means (43) provided to rest on said offboard surface (18).

13 Claims, 6 Drawing Sheets

DEVICE FOR RAMPS

TECHNICAL FIELD

The present invention relates to a device according to the preamble of claim 1 to be placed on or integrated into offboard surfaces, for example barges onto which a ship operator has the intention to discharge cargo over a ramp.

BACKGROUND OF THE INVENTION

Until today, the problem of discharging heavy rolling or tracked cargo from RoRo-ships instream onto barges has mainly been solved by seeking sheltered anchored locations where the effects of waves and swell are dampened by protecting land. The ship's ramp has been put down on the barges, sometimes with a wooden dunnage between the ramp foot and the barge deck, and the cargo has been discharged from the ship to the barge(s) over the ramp.

On open coasts it has until now only been possible to carry out offloading operations when wind and waves have been fair and light.

Experience has shown that present offloading arrangements for RoRo-ships discharging to barges have had a practical limit at a very calm seastate. When wind, waves and swell has increased, twisting and heaving of the stern ramp has forced operations to stop. Around the coasts of the world, the necessary seastate or less is only prevailing in less than 8% of the total available time.

DISCLOSURE OF THE PRESENT INVENTION

The object of the present invention is to reduce the torsion loads imposed on the ramp emanating from the relative movements between a ship and offboard surfaces, such as barges, caused by the waves and swell of the sea thus effectively enlarging the available time-window for operation. The present invention will reduce the torsional loads imposed on the RoRo-ramp from the offboard surfaces, which as barges thereby making discharging operations for tracked and wheeled vehicles possible up to higher seastate. Thus the timewindow when operations are possible will increase from todays 8% to 30% or more.

Said object is achieved by means of the device according to the present invention, which is characterised according to claim 1.

The necessary reduction of the torsional loads induced in the ramp structure by the barge movements is achieved by means of a movable platform/deck on which the ramp foot shall be placed. Said platform is to be equipped with pivoting means along at least one axis.

If necessary, the platform can be resting in hingecups on a second frame, which is equipped with second pivoting means having their axis essentially perpendicularly to the first axis.

This second pair of hinges is resting in hingecups supported from the barge's deck. The level variations between the pivoting platform and the deck of the barges are taken up by fingerflaps attached to the platform and resting on the deck of the barge.

BRIEF DESCRIPTION OF DRAWINGS

The invention will be further described in detail by way of an embodiment, which is apparent from the accompanying drawings, in which.

MODE FOR CARRYING OUT THE INVENTION

Figure 1:
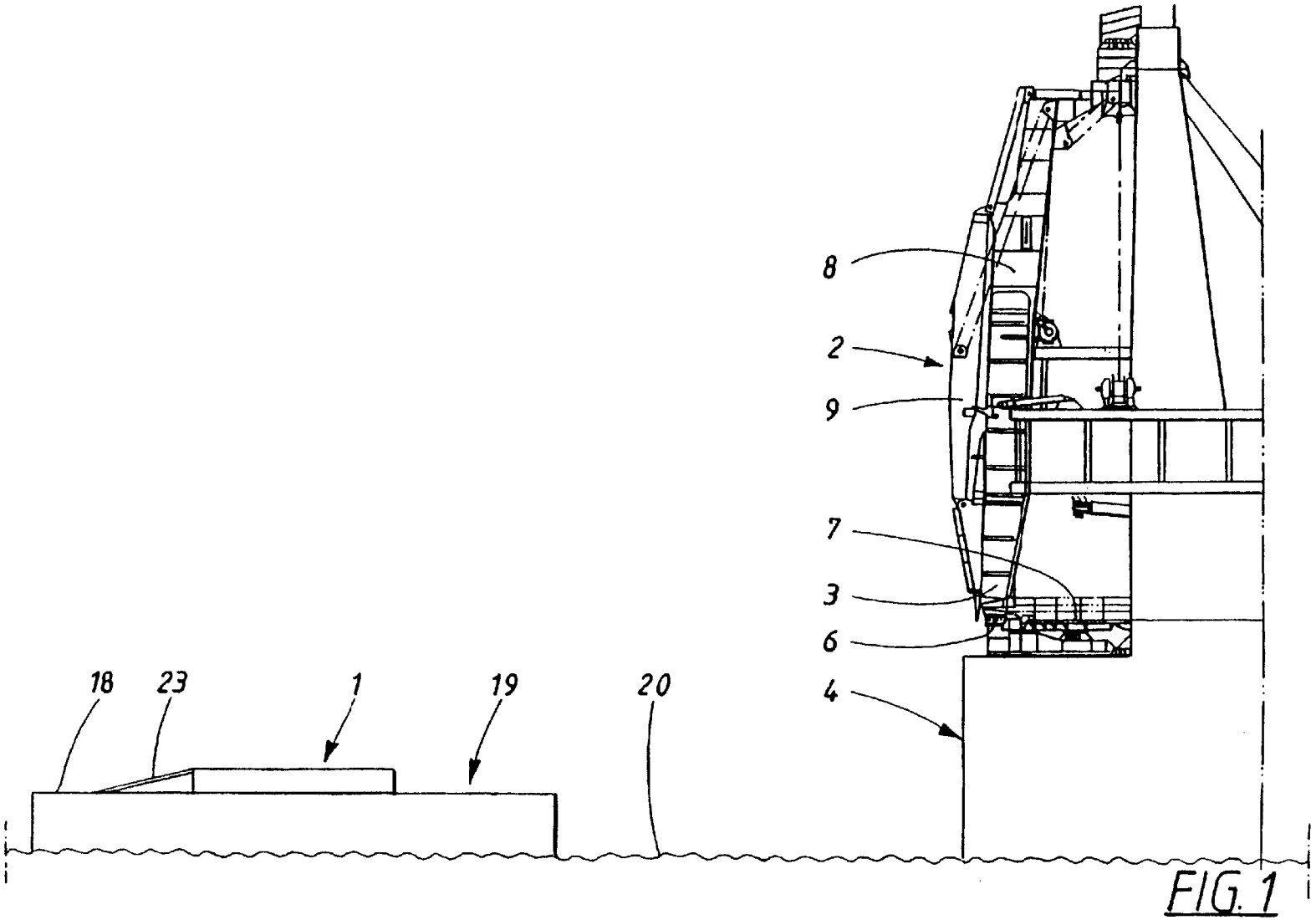
FIG. 1 is a total view showing the ramp device on a barge and a ship's ramp in a stored position on a ship.

The design and use of the ramp device according to the present invention will now described with reference to all FIGS. 1–6. The ramp device 1 forms a support for a ship's ramp 2 which in one end 3 is pivotally connected with a ship 4, see FIG. 1 and 2 and in it's opposite end 5 is arranged to rest in a ramp position on the ramp device 1 according to the present invention, see FIG. 2. In a stored or removed position of the ship's ramp 2, as shown in FIG. 1, the ramp acts as a protection or cover for the ship in order to protect the deck or decks from waves of the sea and also protect the cargo from moving out of the deck The first or inner end 3 of the ship's ramp 2 is provided with pivot means 6, normally a number of hinges, arranged substantially at the level of at least one deck 7 of the ship. The ship 4 is preferably of the type RoRo-ship i.e. having at least one ramp for easily rolling off and on cargo from and to the deck 7 or decks of the ship. The cargo can be of different kinds, for example being vehicles, containers etc which can be transported by means of trucks. In the example as shown the ship cargo is of heavy type and the ramp 2 enables loading and unloading to a position which is relatively distant from the ship. The ship's ramp is in its embodiment of a folded ramp type having an inner member 8 whose inner end 3 has the pivot means 6 for pivotal connection with the ramp of the ship. The ship's ramp has an outer member 9 pivotally connected with the inner member by means of pivot means 10. The outer member 9 of the ship's ramp is also in its outer end pivotally connected by pivot means 14, namely with a ramp foot 11 having a number of finger flaps 12 arranged side by side and are pivotally connected with the ramp foot by means of pivot means 13 in the shape of hinges arranged along a common pivot axis extending substantially parallel with the pivot axis of the pivot means 14 and also with pivot axis of the intermediate pivot means 10 and the pivot axis of the inner pivot means 6.

The ship's ramp 2 has a power means 15 for moving the ship's ramp between its stored position and ramp position. In the example as shown the power means is a motor and a wire 16 or chain, connected with the ship's ramp distant from the inner pivot means 6, namely at the outer end of the inner ramp member 8 and extending to a high point on the ship, involving that the power means can take loads on the ship's ramp from the cargo during unloading and loading in the ramp position. Between the inner and outer member 8, 9 of the ship's ramp 2 there are also arranged power means 40, 41 in the shown example in the form of a motor and a wire or chain enabling the outer member to be converted between downwards position according to FIG. 1 and an extended position in the ramp position according to FIG. 2 The intermediate pivot means 10 in the form of hinges are positioned under the ship's ramp 2 a distance from the outer end of the inner ramp member 8. This involves that the inner ramp member 8 will from an end stop for the outer ramp member 9 resulting into a rigid unit in the ramp position. Also the ramp foot 11 can be provided with power means for example hydraulic cylinders for pivoting the ramp foot relative to the outer member 9 of the ship's ramp.

According to the present invention the ship's ramp 2 is provided to rest on the ramp device 1 and is not by means of its ramp foot 11 resting dizzy on the surface 18 onto which or from which the cargo shall be transported by means of the ship's ramp 2. The surface can be the deck of a barge 19 floating above the surface 20 of the sea, a small ferry and possibly also a shore or a quay. The present invention is especially advantageous in connection with floating units as the problem is that the floating units and the ship 4 in many situations move independently relative each other involving that the deck of the ship and the deck 18 of the barge will deviate from parallel extensions. Deviations around the pivot axis 14 and 6 will be absorbed by means of the pivot means 14 and 6. However, angular deviations between the pivot axis 14, 10 and 6 will cause stress on the hinges and the whole ship's ramp.

Figure 3:
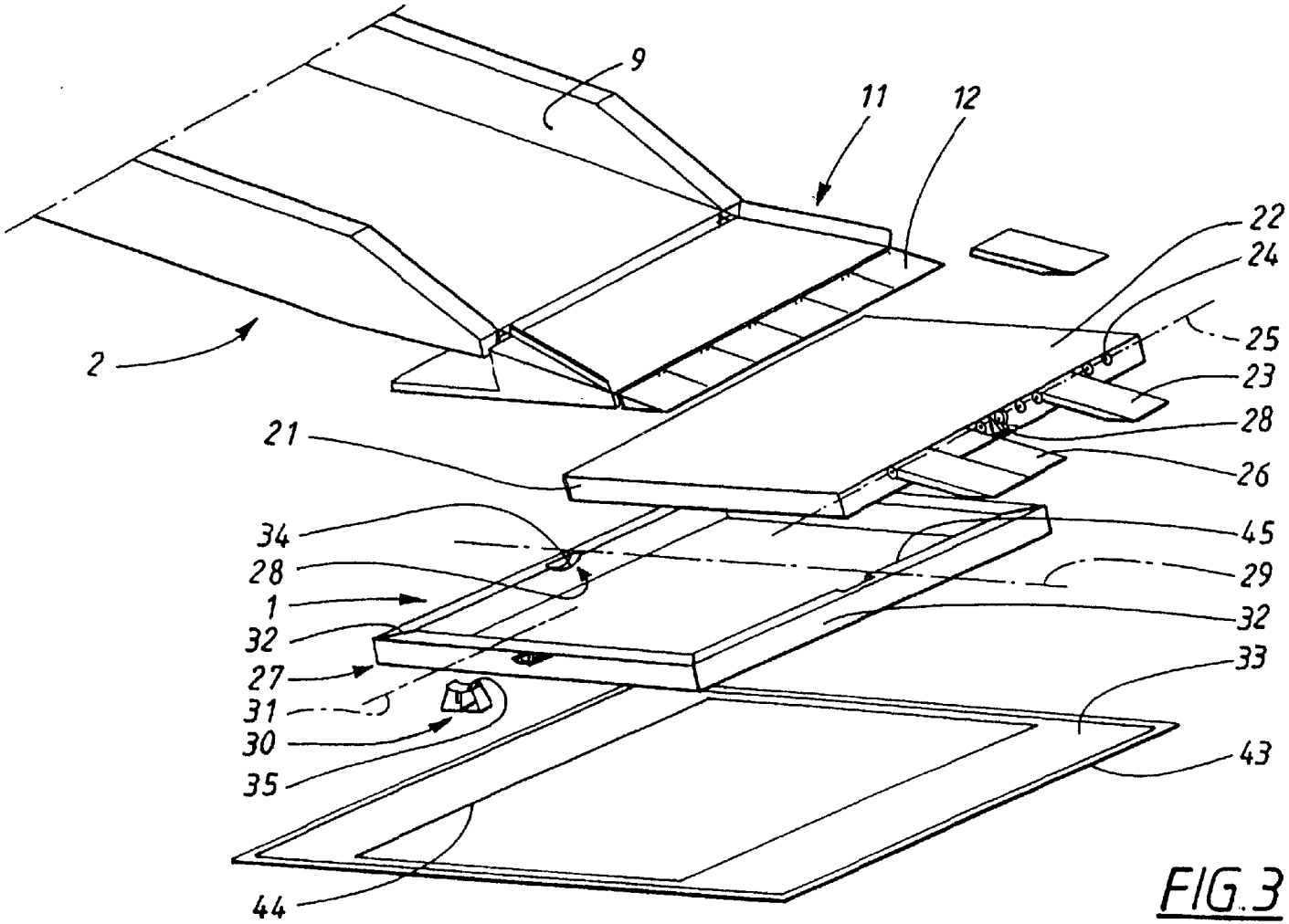
FIG. 3 is an exploded view of the ramp device according to the present invention and part of a ship's ramp.
Figure 4:
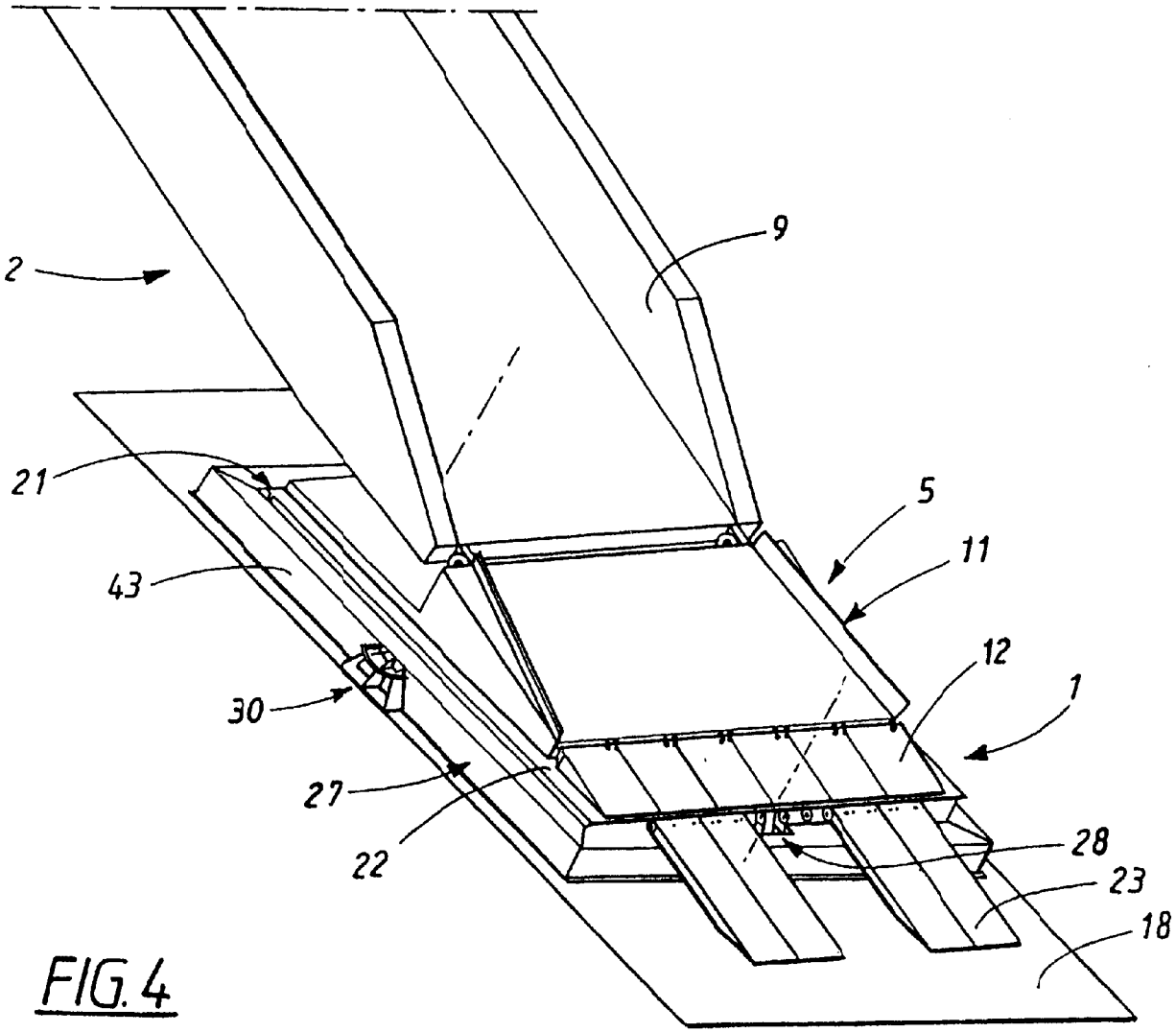
FIG. 4 is a perspective view of the device according to FIG. 1.
Figure 5:
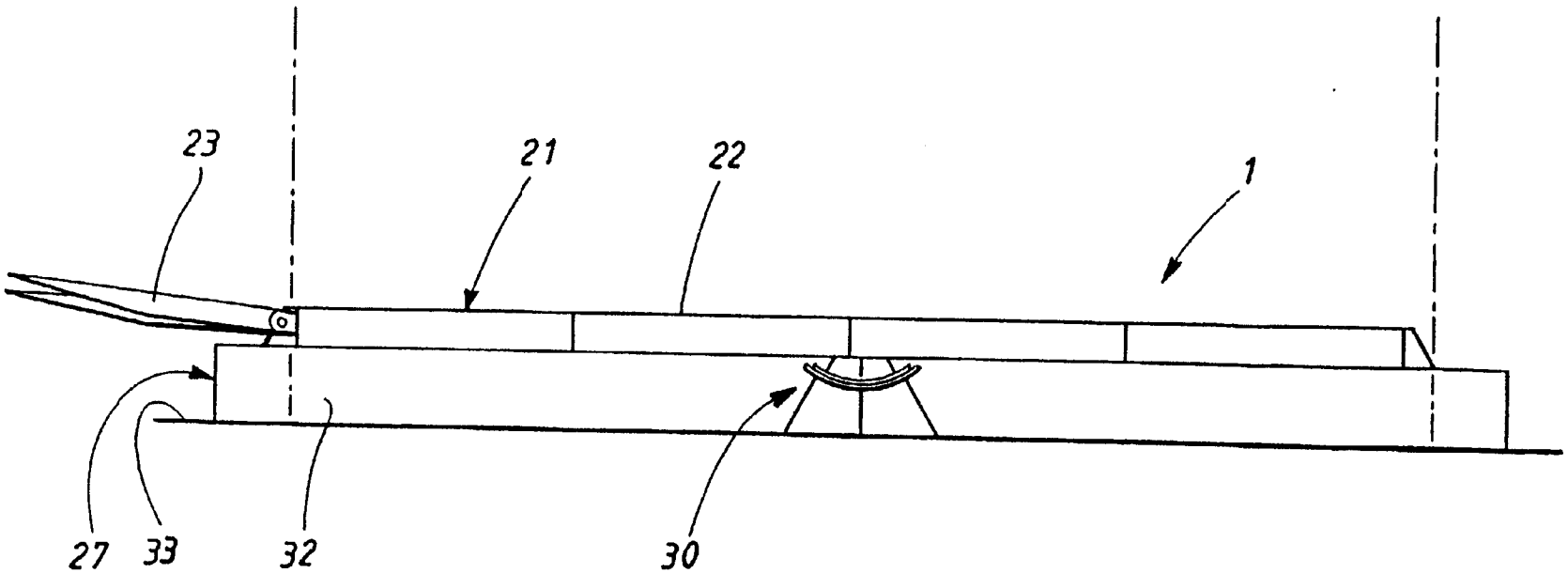
FIG. 5 is a lateral view of the ramp device.
Figure 6:
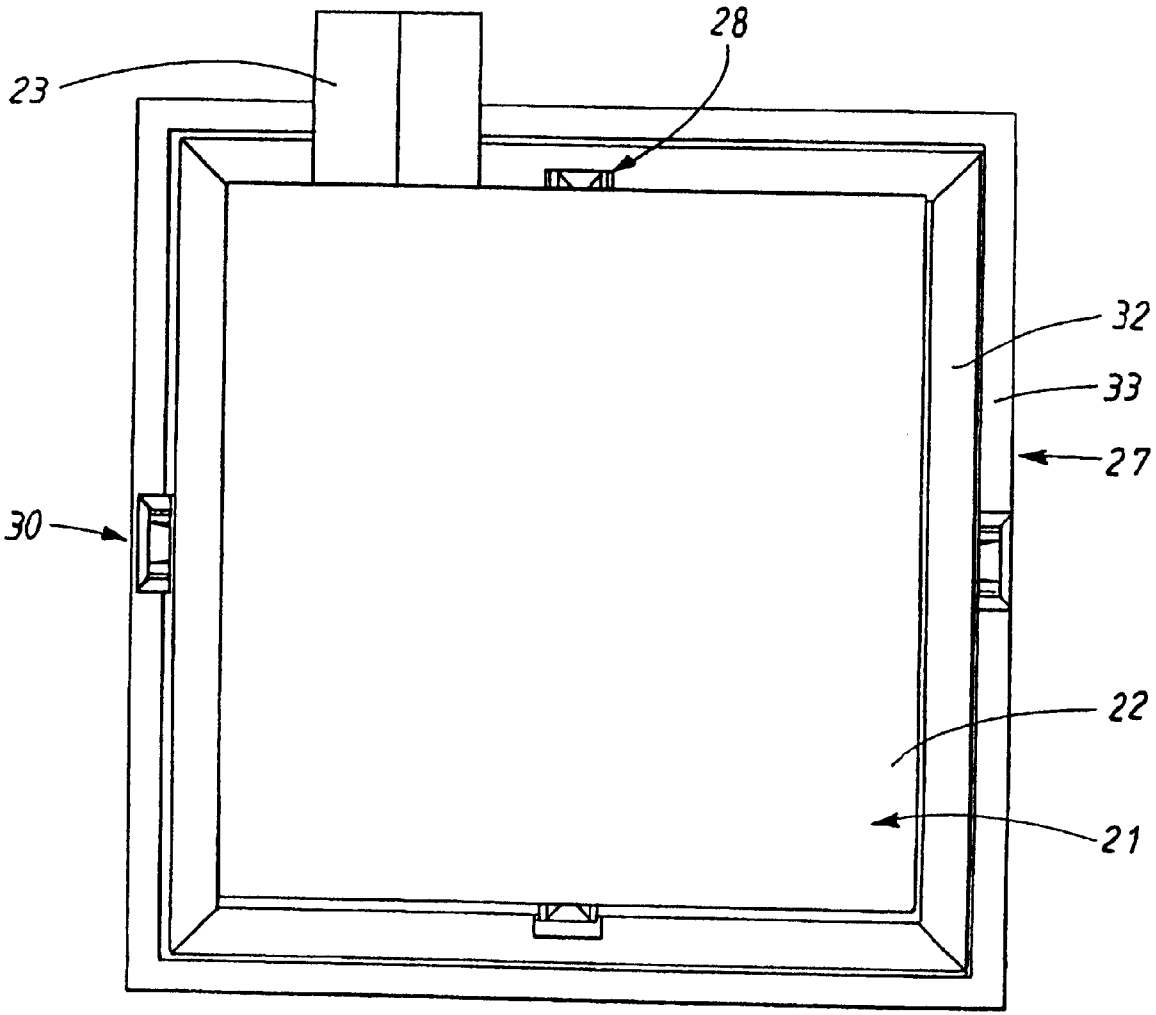
FIG. 6 is a top view of said device according to FIG. 4.

According to the present invention the ship's ramp rests on the ramp device 1, which in turn rests on and is supported by the off-board surface 18, i.e. in this example the deck of the barge 19. For this purpose the device 1 includes a platform 21 having an upwardly faced support 22, see FIG. 3, and outer ramp members in the form of a number of finger flaps 23 pivotally journalled in the platform 21 by means of a number of hinges 24 which form a common pivot axis 25. The hinges are positioned immediately below the surface 22 of the platform 21 in order to form a smooth transition over to ramp surfaces 26 of the finger flaps 23. Preferably the finger flaps are arranged in a continuous row forming a continuous transport surface for the cargo. In FIGS. 3 and 4 some of the finger flaps 23 are removed for illustration purposes.

According to the present invention the platform 22 is not rigidly resting on the support surface 18, i.e. the deck of the barge 19, but is pivotally supported relative to the surface 18. For this purpose the ramp device 1 includes a base member 27 or support member having at least one set of pivoting means 28 forming at least one pivot axis 29 around which the platform 1 can pivot relative to the offboard support surface 18. According to the present invention this pivot a 29 is not parallel with the pivot axis 6, 10, 14 of the ship's ramp 2, but forms a considerable angle relative to said axis and is the shown example at a right angle i.e. substantially 90°.

In the shown example the platform 21 is pivotable relative to the support surface 18 by means of a second set of pivoting means 30 around a second pivot axis 31 which extends transversely to the first pivot axis 25, i.e. substantially 90° thereto.

The base or support unit 27 is in the shown example arranged as a double frame, namely with an intermediate unit or frame 32 in which the platform 21 is pivotally journalled around said first pivot axis 29, and a fixed bottom frame 33 in which the intermediate frame is pivotally journalled around the second pivot axis 31. The fixed bottom frame 33 has bottom support means 43 resting fixed on the offboard surface. The bottom support means 43 can be the downwardly faced bottom surface of the bottom frame 33 or feet, not shown. The bottom support means 43 can be the downwardly faced bottom surface of the bottom frame 33 or feet, not shown.

The first and second sets of pivot means 28, 30 are arranged as hinge cups having bearing surfaces 34, 35 which are cylindrical having a relatively large radius of curvature. In this way the pivot axis 29, 31 are positioned above the centre of gravity making the platform stabile and self adjusting to a stable neutral position. In an unloaded position as shown in FIG. 1 when the ship's ramp is removed the stable position is substantially horizontal irrespective of the movements of the barge. If the ship is stable and takes substantially horizontal position whereas the barge 19 follows the waves the platform surface 22 still takes a horizontal position when the ship's ramp rests on the ramp device 1 according to FIG. 2.

The fixed bottom frame 33 is in the shown example rectangular having a rectangular opening 44, dimensioned to receive the intermediate frame 32, which also is rectangular in the shown example. This frame 32 has also a rectangular opening 45, dimensioned to receive the platform 21, which also is rectangular in the shown example. As a result of this arrangement the ramp device 1 in the shown example will have a very limited height, so that the platform surface 22 will be at a level not far above the support surface of this 18 of the barge 19. However the platform 21 and in the shown example also the intermediate frame 27 must have sufficient space, i.e. sufficient distance between the underside of the platform and underside of the intermediate frame to the basic support surface 18 so that the platform and the intermediate frame can pivot within a sufficient angular interval around their pivot axes 29 and 31 respectively.

The platform 21 will consequently be supported by means of a universal joint suspension, enabling the platform to take any angular position within it's predetermined angular range relative to the surface 18 of the barge 19.

When the ship's ramp 2 will be positioned with it's outer end 5, i.e. it's ramp 11 on to the platform surface 22, preferably with the pivot means 14 positioned vertically above the second pivot axis 31, the platform 21 will adjust itself by pivoting around the first pivot axis 29 so that the platform surface 22 will extend parallel with the pivot axes of the ships ramp 2, namely the axes of the pivot means 6, 10. 14. This parallellity will be maintained within a predetermined angular interval independent from the angular variations and deviations of the surface 18 relative to a horizontal plane. These variations and deviations will occur when the sea is in motion, i.e. the sea surface 20 will cause the barge to sway or rock. Primarily the pivot around the first pivot axis 29 is sufficient for many installations. In a simple embodiment the second pivot means 30 can be removed and the frame 27 can be one single frame. Also the second set of pivot means 35 can be locked or some support member under the platform along the finger flaps 23 side can support the platform.

However some slight deviations from the above-mentioned parallelity between the platform 21 and the ramp axes can occur due to for example inertia of the platform 21. These deviations will in a certain extent be absorbed by means the row of finger flaps 12 which can pivot independently from each other and take different angular positions. The angular deviations between the platform surface 22 and the support surface 18 of the barge will be absorbed by means of the finger flaps 23 which can take angular positions which are different from each other due to the variating distance between the pivot axis 25 and the support surface 18.

Figure 2:
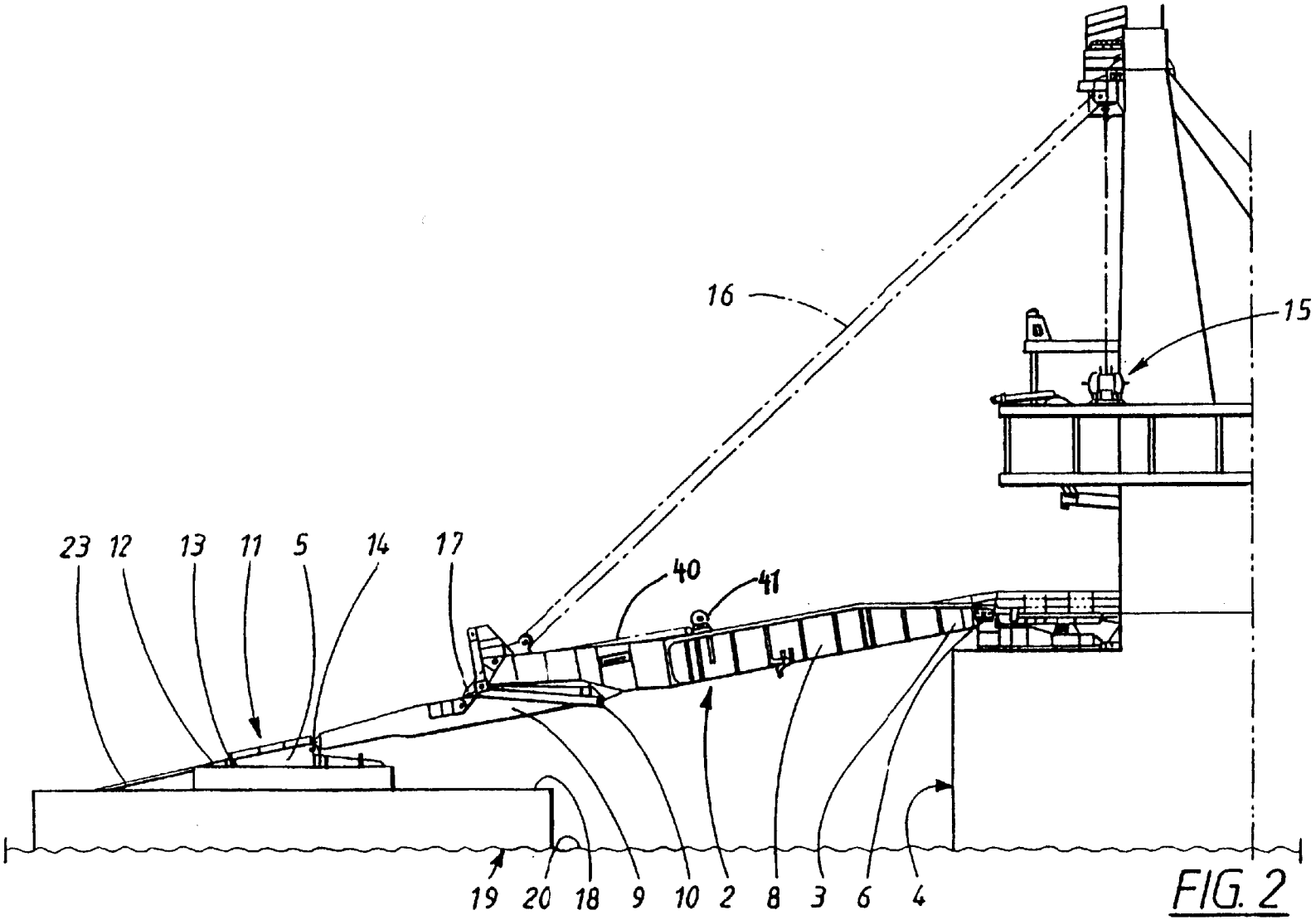
FIG. 2 is a total view, showing the ship's ramp in a ramp position resting on the barge.

Especially from FIGS. 2 and 4 it is apparent that the ships ramp 2 including it's ramp foot 11 with it's finger flaps 12 and the finger flaps 23 of the platform 21 will form a continuous transport surface from the ships deck 7 onto the deck 18 of the barge. The barge 19 is shown in the drawings with a very limited size, however the bard has normally relatively large receiving or loading surface onto which the cargo can be transported for further transport to land, i.e. a shore or a quai. The barge has normally a ramp, not shown, for unloading the cargo to land after moving the barge further, where the depth of the sea is too small for the ship 4.

The invention is not limited to the embodiment as described above and shown the drawings, but can be modified within the scope of the accompanying claims. For example the ramp device 1 can have one single rigid frame in which the platform 21 is pivoted around the first pivot axis 29. For large vehicles the finger flaps 23 can be deleted. The platform and frame can have different form and proportions, for example circular. The pivot means 28, 30 can be of different kind, for example having a shaft resting in a bearing.

What is claimed is:

1. A device for transporting cargo between a deck of a ship and an offboard surface, comprising at least one ship ramp having an inner end pivotally connected with said ship and an outer end capable of being supported by said offboard surface when said ship ramp is in a loading position;

a base unit having bottom support means capable of resting on said offboard surface; and a platform having platform pivot means for pivotal suspension in said base unit, said platform further having top support means to receive and support said outer end of said ship ramp, whereby said device can accommodate angular displacement of said ship ramp relative to said offshore surface.

2. A device according to claim 1, wherein said platform pivot means includes a platform pivot axis and said ship ramp includes a ramp pivot axis located between said ship ramp and said ship; said platform pivot axis being capable of shifting from a position that is parallel to said ramp pivot axis to a position that is not parallel with said ramp pivot axis.

3. A device according to claim 2 wherein said platform pivot axis extends in a direction transverse to said ramp pivot axis.

4. A device according to claim 1 wherein said platform further comprises a plurality of finger flaps for resting on said offboard surface, said finger flaps independently pivotally connected to said platform.

5. A device according to claim 1 wherein said base unit further comprises a bottom frame provided to rest on said offboard surface; and said platform pivot means further comprises an intermediate frame, first pivot means pivotally suspending said platform in said intermediate frame around a first pivot axis; and second pivot means for pivotally connecting said intermediate frame to said bottom frame about a second pivot axis, said second pivot axis extending transversely to said first pivot axis.

6. A device for transporting cargo between a deck of a ship and an offboard surface, comprising at least one ship ramp having an inner end pivotally connected with said ship and an outer end capable of being supported by said offboard surface when said ship ramp is in a loading position;

a base unit having bottom support means capable of resting on said offboard surface; and a platform having platform pivot means for pivotal suspension in said base unit, said platform further having top support means to receive and support said outer end of said ship ramp, wherein said device can accommodate angular displacement of said ship ramp relative to said offshore surface, said platform further comprising a plurality of finger flaps for resting on said offboard surface, said finger flaps independently pivotally connected to said platform.

7. A device according to claim 6, wherein said platform pivot means includes a platform pivot axis and said ship ramp includes a ramp pivot axis located between said ship ramp and said ship; said platform pivot axis being capable of shifting from a position that is parallel to said ramp pivot axis to a position that is not parallel with said ramp pivot axis.

8. A device according to claim 7 wherein said platform pivot axis extends in a direction transverse to said ramp pivot axis.

9. A device according to claim 6 wherein said base unit further comprises a bottom frame provided to rest on said offboard surface; and said platform pivot means further comprises an intermediate frame, first pivot means pivotally suspending said platform in said intermediate frame around a first pivot axis; and second pivot means for pivotally connecting said intermediate frame to said bottom frame about a second pivot axis, said second pivot axis extending transversely to said first pivot axis.

10. A device for transporting cargo between a deck of a ship and an offboard surface, comprising at least one ship ramp having an inner end pivotally connected with said ship and an outer end capable of being supported by said offboard surface when said ship ramp is in a loading position;

a base unit having bottom support means capable of resting on said offboard surface; said base unit further having a bottom frame provided to rest on said offboard surface; and a platform having platform pivot means for pivotal suspension in said base unit, said platform further having top support means to receive and support said outer end of said ship ramp, wherein said device can accommodate angular displacement of ship ramp relative to said offshore surface;

said platform pivot means further comprising an intermediate frame, first pivot means pivotally suspending said platform in said intermediate frame around a first pivot axis; and second pivot means for pivotally connecting said intermediate frame to said bottom frame about a second pivot axis, said second pivot axis extending in a direction that is transverse to said first pivot axis.

11. device according to claim 10, wherein said platform pivot means includes a platform pivot axis and said ship ramp includes a ramp pivot axis located between said ship ramp and said ship; said platform pivot axis being capable of shifting from a position that is parallel to said ramp pivot axis to a position that is not parallel with said ramp pivot axis.

12. A device according to claim 11 wherein said platform pivot axis extends in a direction transverse to said ramp pivot axis.

13. A device according to claim 10, wherein said platform further comprises a plurality of finger flaps for resting on said offboard surface, said finger flaps independently pivotally connected to said platform.

* * * * *

UNITED STATES PATENT AND TRADEMARK OFFICE

CERTIFICATE OF CORRECTION

PATENT NO. : 6,536,363 B1
DATED : March 25, 2003
INVENTOR(S) : Gustaf Carlberg

It is certified that error appears in the above-identified patent and that said Letters Patent is hereby corrected as shown below:

Title page,
Item [57], ABSTRACT, please substitute the following:

-- The present invention relates to a ramp device located on an offboard surface to receive and provide support for a movable ramp of a ship. The ramp device reduces torsional loads caused by the movements of the offboard surface by means of a platform or deck upon which the ship's movable ramp is placed. Additionally, finger flaps positioned on the ramp device provide further stability and support by absorbing deviations between the ramp device and the movable ship ramp. --

Column 1,
Lines 26 and 27, "has" should read -- have --.
Line 32, "torsion" should read -- torsional --.
Line 54, "axis" should read -- axes --.

Column 2,
Line 8, delete "and".
Line 12, after "now" insert -- be --.
Line 15, "FIG." should read -- FIGS. --.
Line 15, "it's should read -- its --.
Line 21, after "deck" insert -- . --.
Line 40, after "and" insert -- which --.
Line 63, "from" should read -- form --.
Line 65, after "means" insert -- , --.
Line 66, after "example" insert -- , --.

Column 3,
Line 3, "dizzy" should read -- directly --.
Line 40, "a" should read -- axis --.
Line 65, "axis" should read -- axes --.
Line 66, "stabile" should read -- stable --.

UNITED STATES PATENT AND TRADEMARK OFFICE

CERTIFICATE OF CORRECTION

PATENT NO. : 6,536,363 B1
DATED : March 25, 2003
INVENTOR(S) : Gustaf Carlberg

It is certified that error appears in the above-identified patent and that said Letters Patent is hereby corrected as shown below:

Column 4,
Line 14, after “arrangement” insert -- , --.
Line 16, delete “of this”.
Lines 27, 29 and 30, “it’s” should read -- its --.
Lines 35 and 60, “ships” should read -- ship’s --.
Line 50, after “to” insert -- , --.
Line 50, after “example” insert -- , --.
Line 52, after “means” insert -- of --.
Line 61, “it’s” (first occurrence) should read -- its --.
Line 61, “it’s” (second occurrence) should read -- its --.
Line 63, “ships” should read -- ship’s --.
Line 65, “bard” should read -- barge --.

Column 5,
Line 1, “quai” should read -- quay --.
Line 6, after “shown” insert -- in --.

Column 6,
Line 39, “after “of” insert -- said --.
Line 48, after “11.” insert -- A --.

Signed and Sealed this

Second Day of September, 2003

JAMES E. ROGAN
*Director of the United States Patent and Trademark Office*